US007762862B2

(12) United States Patent
Rotundo et al.

(10) Patent No.: US 7,762,862 B2
(45) Date of Patent: Jul. 27, 2010

(54) HOUSE TOY AND DISPLAY

(76) Inventors: Frank L. Rotundo, 720 Gordon Ter., 11F, Chicago, IL (US) 60613; Anne T. Riley, 104 S. College St., Batavia, IL (US) 60510

( * ) Notice: Subject to any disclaimer, the term of this patent is extended or adjusted under 35 U.S.C. 154(b) by 1176 days.

(21) Appl. No.: 10/885,366

(22) Filed: Jul. 6, 2004

(65) Prior Publication Data

US 2006/0009121 A1 Jan. 12, 2006

(51) Int. Cl.
*B65D 81/36* (2006.01)

(52) U.S. Cl. ..... 446/76; 434/72

(58) Field of Classification Search ..... 446/487, 446/71, 73, 76, 75; 434/72–80; 211/131.1; 108/103, 106
See application file for complete search history.

(56) References Cited

U.S. PATENT DOCUMENTS

| | | | | | |
|---|---|---|---|---|---|
| 513,688 | A | * | 1/1894 | Smith | 446/478 |
| 922,888 | A | * | 5/1909 | Grunwaldt | 47/14 |
| 1,448,253 | A | * | 3/1923 | Bodker | 312/202 |
| 2,030,899 | A | * | 2/1936 | Scurlock | 211/77 |
| 2,059,964 | A | * | 11/1936 | Hempstone | 446/76 |
| 2,118,444 | A | * | 5/1938 | Mueller | 211/131.1 |
| 2,199,196 | A | * | 4/1940 | Evans | 222/113 |
| 2,327,742 | A | * | 8/1943 | Rosenberg | 211/131.1 |
| 2,441,761 | A | * | 5/1948 | Guelicher | 446/110 |
| D163,479 | S | * | 5/1951 | Ralston | D21/506 |
| 2,750,051 | A | * | 6/1956 | Wassell | 108/103 |
| 2,879,507 | A | * | 3/1959 | Bonistall | 343/721 |
| 3,269,034 | A | * | 8/1966 | Glass et al. | 434/80 |
| 3,526,443 | A | * | 9/1970 | Leslie | 312/125 |
| 3,636,299 | A | * | 1/1972 | Stewart, Jr. | 219/201 |
| 3,641,950 | A | * | 2/1972 | Axhamre | 108/60 |
| 3,698,104 | A | * | 10/1972 | Sutton | 434/432 |
| 3,733,112 | A | * | 5/1973 | Marquardt | 312/97.1 |
| 3,945,132 | A | * | 3/1976 | Parmelee | 434/76 |
| 4,219,960 | A | * | 9/1980 | Walmer et al. | 446/110 |
| 4,233,778 | A | | 11/1980 | Lemelson | |
| 4,432,151 | A | * | 2/1984 | Morris | 40/661 |
| 4,657,147 | A | * | 4/1987 | Le Mer | 211/58 |
| 5,524,775 | A | * | 6/1996 | Kaine | 211/131.1 |
| 5,830,031 | A | | 11/1998 | O'Brien et al. | |
| 5,910,037 | A | * | 6/1999 | Bach et al. | 446/108 |
| 6,029,828 | A | | 2/2000 | Robbins et al. | |
| 6,206,493 | B1 | * | 3/2001 | Sanchez-Levin et al. | 312/125 |
| 6,439,406 | B1 | | 8/2002 | Duhon | |
| 6,524,107 | B1 | * | 2/2003 | Brown | 434/72 |
| 6,565,413 | B2 | | 5/2003 | Brownrigg | |
| 6,705,109 | B2 | * | 3/2004 | DeMars | 62/457.2 |

FOREIGN PATENT DOCUMENTS

| | | | | |
|---|---|---|---|---|
| GB | 2233889 | A | * | 1/1991 |

* cited by examiner

*Primary Examiner*—Bena Miller

(57) ABSTRACT

A house toy and display including a base having a base fitting, and a plurality of room modules, each of the plurality of room modules having a floor and at least one wall. The floor has a room module fitting complementary in shape to the base fitting to retain the plurality of room modules on the base. In one embodiment, the base fitting is a recess formed in the base; and the room module fitting is the floor of the room module.

2 Claims, 7 Drawing Sheets

HOUSE TOY AND DISPLAY

TECHNICAL FIELD

The technical field of this invention is amusement devices such as modular toys that can be assembled into a unit, particularly, house toys and displays.

BACKGROUND OF THE INVENTION

House toys, such as doll houses, appeal to both young and old. Many doll houses are elaborate, requiring considerable time and expense to reproduce the real world in miniature. One problem with such elaborate doll houses is that the fixtures and decorative scheme are fixed when the doll house is finished. It is impractical to make changes for the season or on a whim, and impossible to change the relative location of the rooms.

Similarly, collectible displays are usually in a fixed configuration. Small collectibles, such as thimbles, cannot be easily re-arranged to show off the whole collection. The small collectibles must be rotated individually to a prominent position in the display—a time consuming process that risks damaging the collectibles.

It would be desirable to have a house toy and display that would overcome the above disadvantages.

SUMMARY OF THE INVENTION

One aspect of the present invention provides a house toy and display that allows modular changes of whole rooms.

Another aspect of the present invention provides a house toy and display that allows simultaneous display of selected rooms.

Another aspect of the present invention provides a house toy and display that allows re-arrangement without handling delicate collectibles.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

DESCRIPTION OF PRESENTLY PREFERRED EMBODIMENTS

Figure 1:
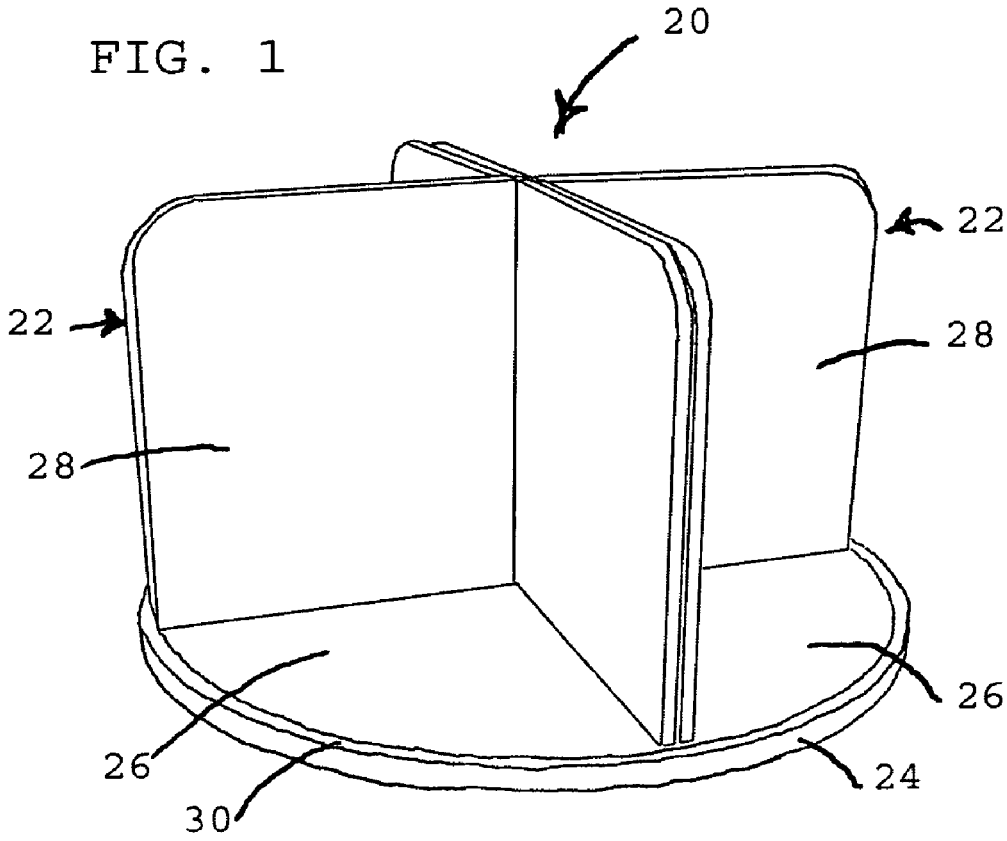
FIGS. 1-3 show a perspective, top, and exploded view, respectively, of a house toy and display made in accordance with the present invention.
Figure 2:
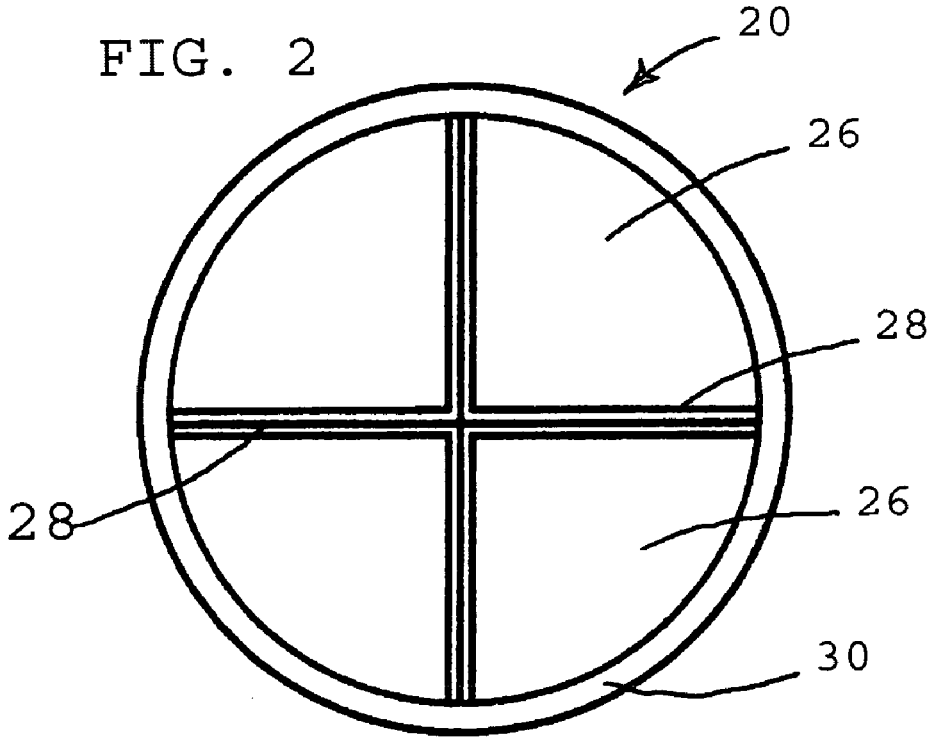
Figure 3:
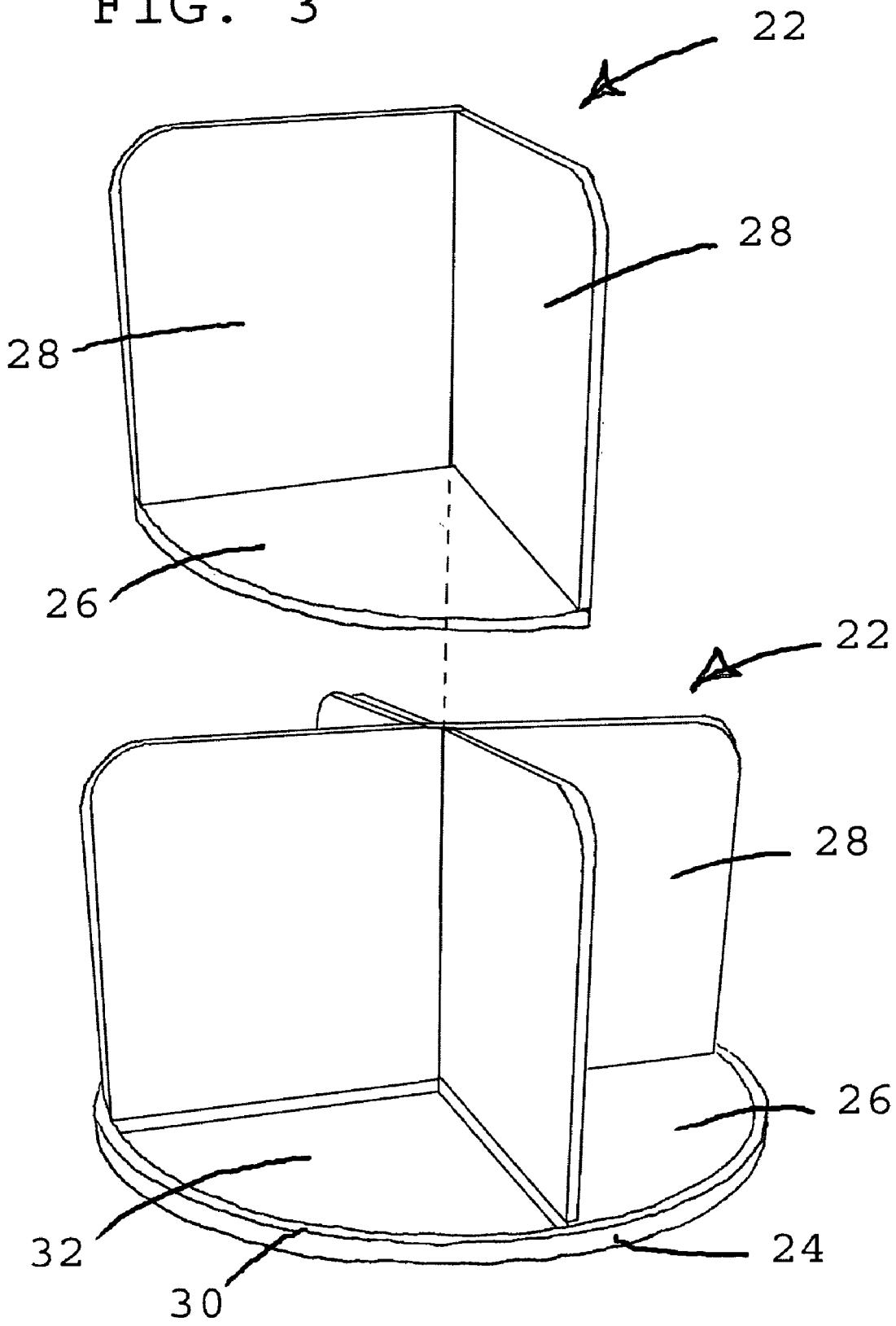

FIGS. 1-3 show a perspective, top, and exploded view, respectively, of a house toy and display. FIG. 1 shows the house toy and display assembled; FIG. 2 shows the house toy and display from the top; and FIG. 3 shows the house toy and display with one of the room modules removed.

The house toy and display 20 comprises a plurality of room modules 22 seated in a base 24. Each room module 22 includes a floor 26 and at least one wall 28. The wall 28 is substantially perpendicular the floor 26. The base 24 includes a rim 30 defining a recess 32. The floors 26 of the plurality of room modules 22 fit within the recess 32. In this embodiment, the recess 32 is the base fitting and the floor 26 is the room module fitting, the floor 26 being received in the recess 32. The floor and walls of each room module 22 can be outfitted with decorative elements as a doll house or with display fixtures to hold collectibles. In operation, the room modules 22 can be switched around to different positions on the base 24 to achieve different arrangements. Some room modules 22 can be stored off the base 24 and other room modules substituted. The individual room modules 22 not in use in the house toy and display 20 can be stored away or displayed individually. In one embodiment, the base 24 includes a turntable (not shown) so that the house toy and display 20 can be rotated to display different room modules 22.

In the example illustrated, the base 24 is circular and the floor 26 of each of the room modules 22 is pie-shaped. Pie-shaped is defined as describing an arc between 0 and 360 degrees. Those skilled in the art will appreciate that many other shapes are possible. The base 24 can be square, rectangular, elliptical, hexagonal, octagonal, polygonal, or any other closed planar shape. The shape of the floor 26 of the room modules 22 can be any set of shapes which lock the room modules 22 within the recess 32. The floors of the room modules can be different sizes and shapes. For example, a circular base can hold one room module with a semi-circular floor and two room modules with quarter-circular floors. The area of the floors of the room modules can be less than the area of the recess, as long as the floors of the room modules secure the room modules against the inner perimeter of the rim. For example, a circular base can use room modules with pie-shaped floors, but having the point removed from the pie-shape to leave an empty space in the center of the recess when the room modules are installed.

In the example illustrated, the walls 28 in a single room module 22 are two panels at right angles to each other. In alternative embodiments, the walls can be a single curving panel or a greater number of flat panels. The walls 28 are substantially perpendicular to the floor 26, but can curve along the floor if an arched effect is desired. The walls 28 can include communicating apertures (not shown) positioned to correspond to communicating apertures in the other room modules to provide windows and doors between adjacent room modules.

The house toy and display 20 can be made of any sturdy material, such as plastic, fiberboard, wood, metal, or the like. The room modules 22 are held on the base 24 by their weight and restrained by the rim 30. In alternative embodiments, the base 24 and the room modules 22 can include mating fasteners, such as magnets, snaps, hook and loop material, restickable adhesive glue, or the like, to further secure the room modules 22 to the base 24. Mating fasteners can also be used between adjacent walls to secure adjacent room modules 22 to each other.

Figure 4:
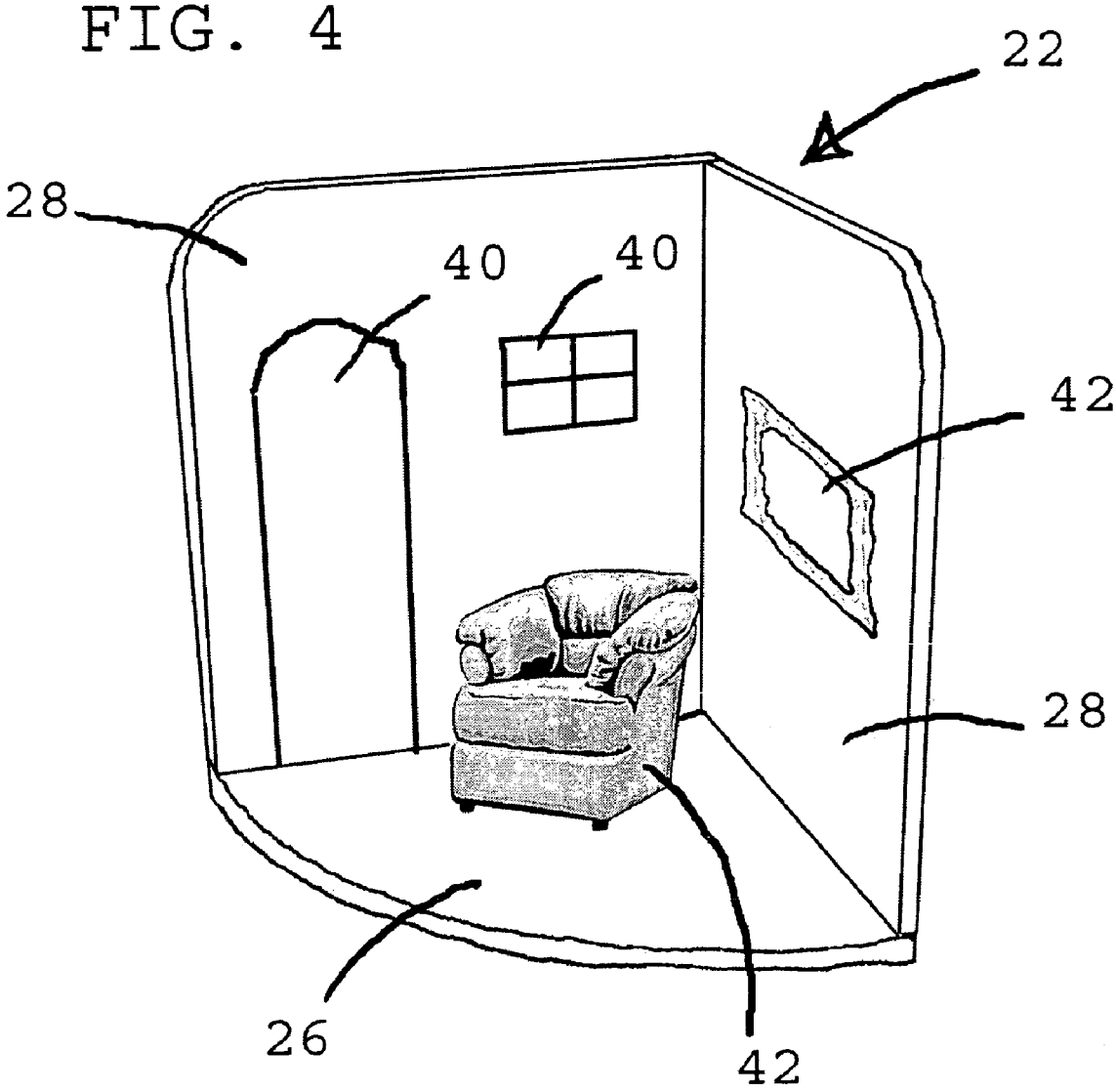
FIGS. 4 & 5 show perspective views of a room module used as a house toy and display, respectively, for a house toy and display made in accordance with the present invention.
Figure 5:
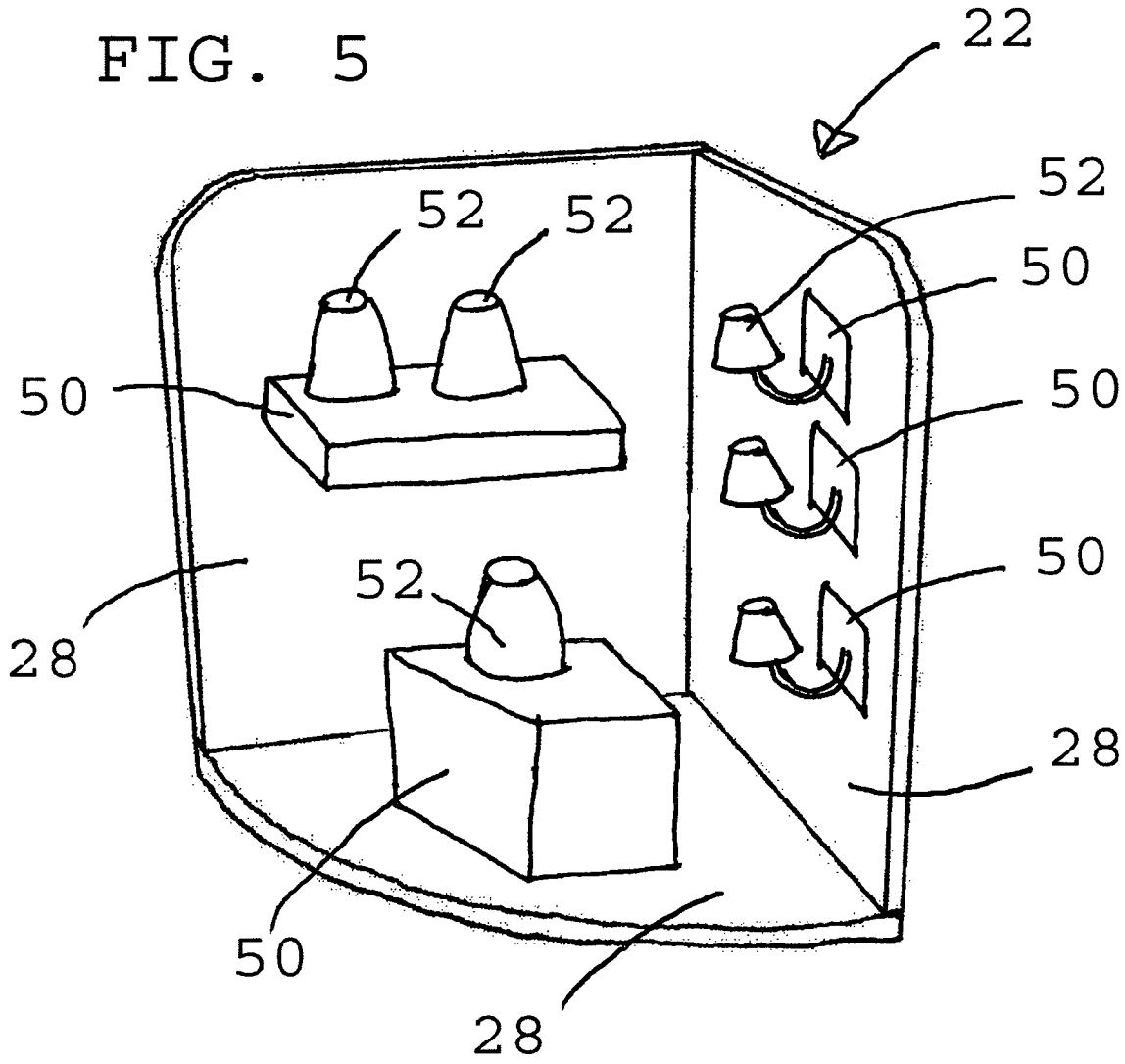

FIGS. 4 & 5, in which like elements share like reference numbers with FIGS. 1-3, show perspective views of a room module used as a house toy and display, respectively.

Referring to FIG. 4, which shows the room module used as a house toy, the room module 22 includes a floor 26 and walls 28. Communicating apertures 40 in the walls 28 provide windows and doors between adjacent room modules with complementary communicating apertures. Decorative items 42, such as furniture, dolls, figurines, and the like, are placed on the floor 26 and walls 28 for display or for play and amusement.

The walls 28 are treated to provide a desired decorative pattern with applied decorative coverings, such as paint or wallpaper, or include a decorative pattern within the structure of the walls 28. In an alternative embodiment, the walls 28 are finished with a plastic or polymer finish to which plastic cutouts will adhere, such as Colorforms® interchangeable design stickers. In another alternative embodiment, the walls 28 include a smooth, erasable surface which can be decorated with crayons or dry erase markers. In yet another alternative embodiment, the walls 28 include magnets or other fasteners for attachment of decorative elements.

Those skilled in the art will appreciate that room modules 22 can be used in various combinations and with various features to enhance the satisfaction of the user. For example, each of the room modules 22 displayed on one base can be a representation of the same room decorated for different seasons or different historical periods. Each room module 22 can also include a display enhancement feature, such as a lighting or music system appropriate for the decorative scheme. A typical lighting system includes a power source, such as a battery, and a light source, such as an incandescent bulb or a light emitting diode. A typical music system includes a power source, such as a battery, a programmed digital music chip, a switch, and a speaker. The room module 22 can also include electrical connections to power decorative items within the room module.

Referring to FIG. 5, which shows the room module used as a display, the room module 22 includes a floor 26 and walls 28. Fixtures 50 are placed on the floor 26 and walls 28 for display of collectible items 52, such as thimbles, spoons, dolls, or any other collectible item the user desires to display. In one embodiment, the fixtures 50 are attached to the floor 26 or walls 28. In an alternative embodiment, the floor 26 or walls 28 include fasteners, such as magnets, snaps, hook and loop material, restickable adhesive glue, or the like, for attachment of the fixtures 50 to the floor 26 or walls 28. Each room module 22 can also include a display enhancement feature, such as a lighting or music system, appropriate for the particular collectible items displayed.

Figure 6:
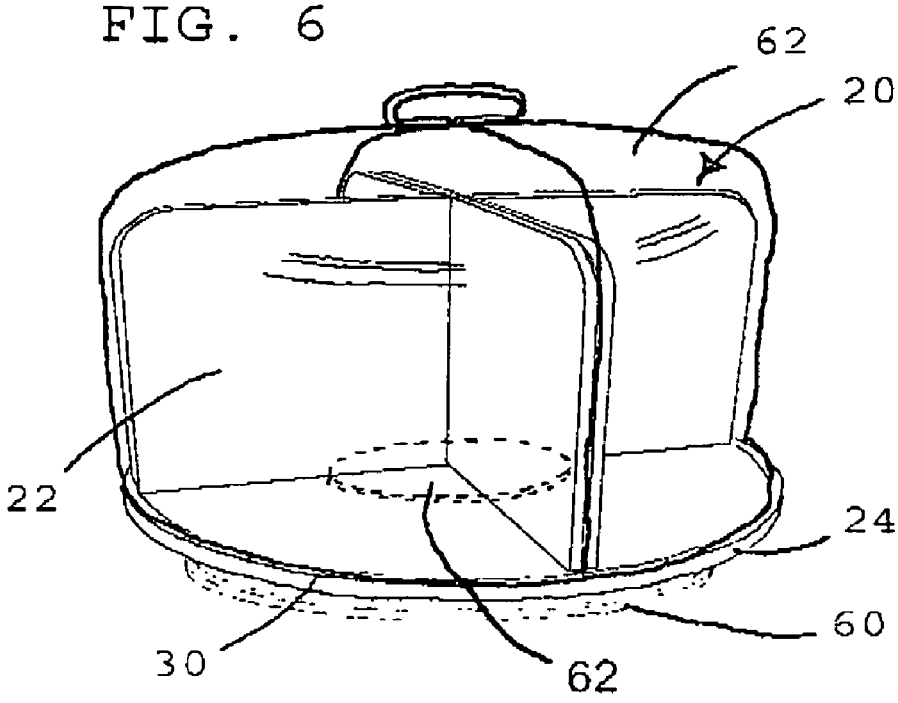
FIG. 6 shows a perspective view of a house toy and display made in accordance with the present invention including a cover and turntable.

FIG. 6, in which like elements share like reference numbers with FIGS. 1-3, shows a perspective view of a house toy and display including a cover and turntable. The cover 62 encloses the room modules 22 of the house toy and display 20 to protect the room modules 22 from dust or disturbance. The turntable 60 supports the base 24 of the house toy and display 20, allowing the house toy and display 20 to be rotated and particular room modules 22 to be prominently presented or examined.

The cover 62 rests on the rim 30 of the base 24. In an alternative embodiment, the cover 62 and the base 24 include mating portions to secure the cover 62 to the base 24 for transport or storage. The cover 62 is typically made of plastic, glass, or other moldable materials. The material is transparent for display of the room modules 22. Alternatively, the material forming the cover 62 can be tinted or opaque to protect the room modules 22 from damage by light. The cover 62 can also include a display enhancement feature, such as a lighting or music system, to enhance display and use of the room modules 22.

The base 24 rests on the turntable 60. In an alternative embodiment, the base 24 is secured to the turntable 60. The turntable 60 is typically a channel or ball bearing turntable with concentric bearing rings providing free rotation. The turntable 60 can include a display enhancement feature, such as a lighting or music system, to enhance display and use of the room modules 22. The turntable 60 is motor 62 driven so the base 24 rotates automatically.

Figure 7:
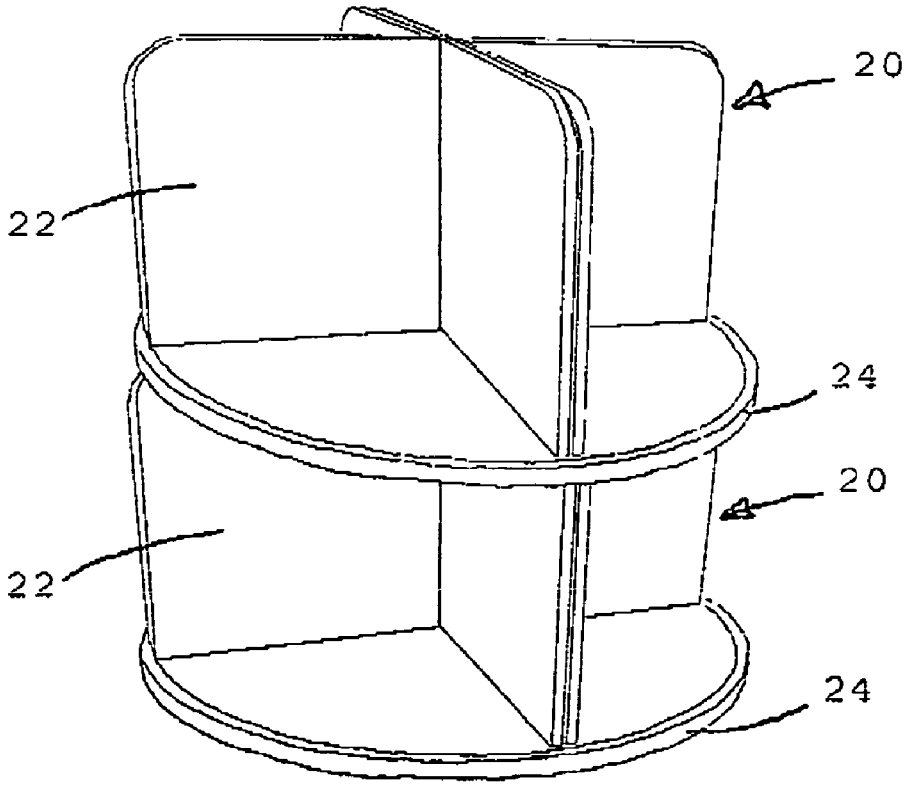
FIG. 7 shows a perspective view of a house toy and display made in accordance with the present invention in a stacked configuration.

FIG. 7, in which like elements share like reference numbers with FIGS. 1-3, shows a perspective view of a house toy and display in a stacked configuration. A plurality of house toy and displays 20 are stacked to provide additional storage or display. The base 24 can be indexed with the adjacent group of room modules 22 to align and secure one house toy and display with the next. In an alternative embodiment, a turntable as discussed for FIG. 6 is provided between adjacent groups of room modules 22, so that each of the house toy and displays 20 can be rotated independently of the others.

Figure 8:
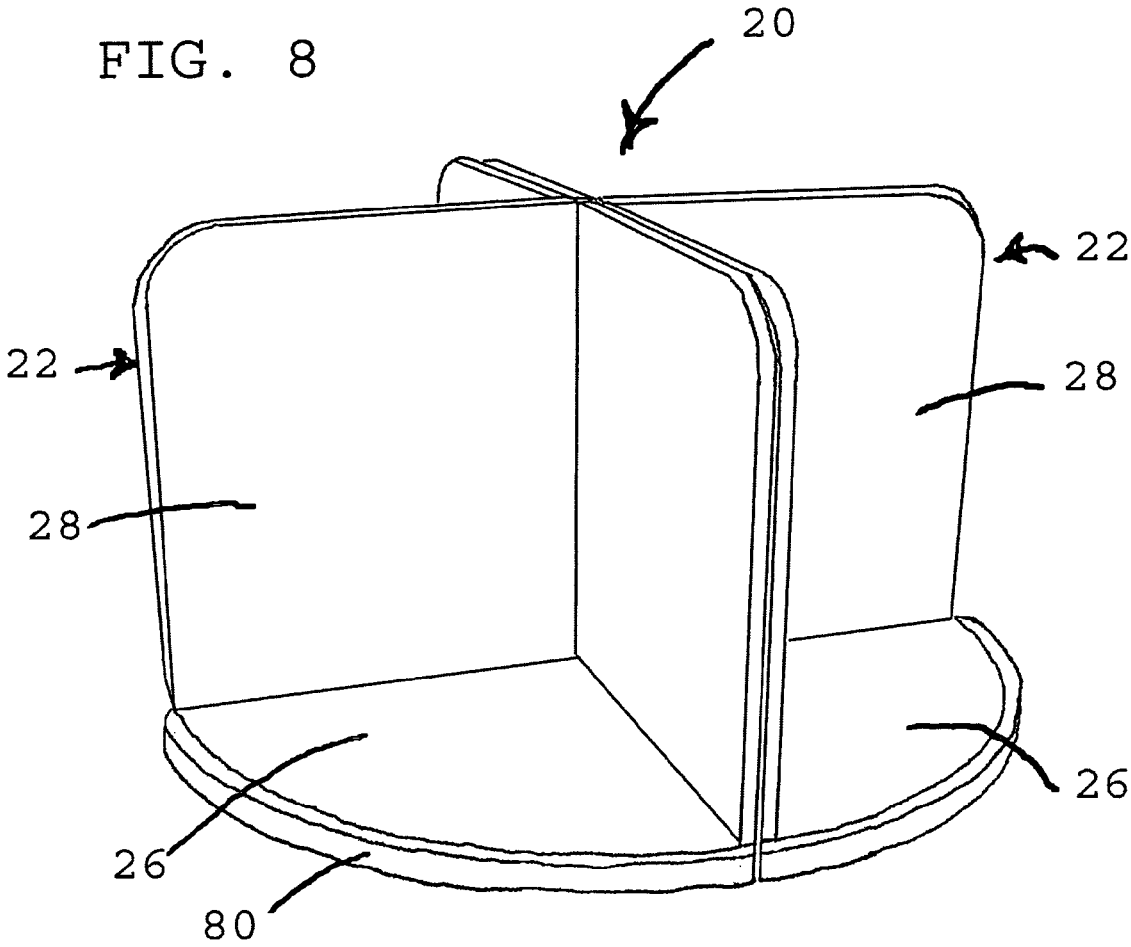
FIGS. 8-10 show a perspective view, top view of the base, and bottom view of the room module, respectively, of another embodiment of a house toy and display made in accordance with the present invention.
Figure 9:
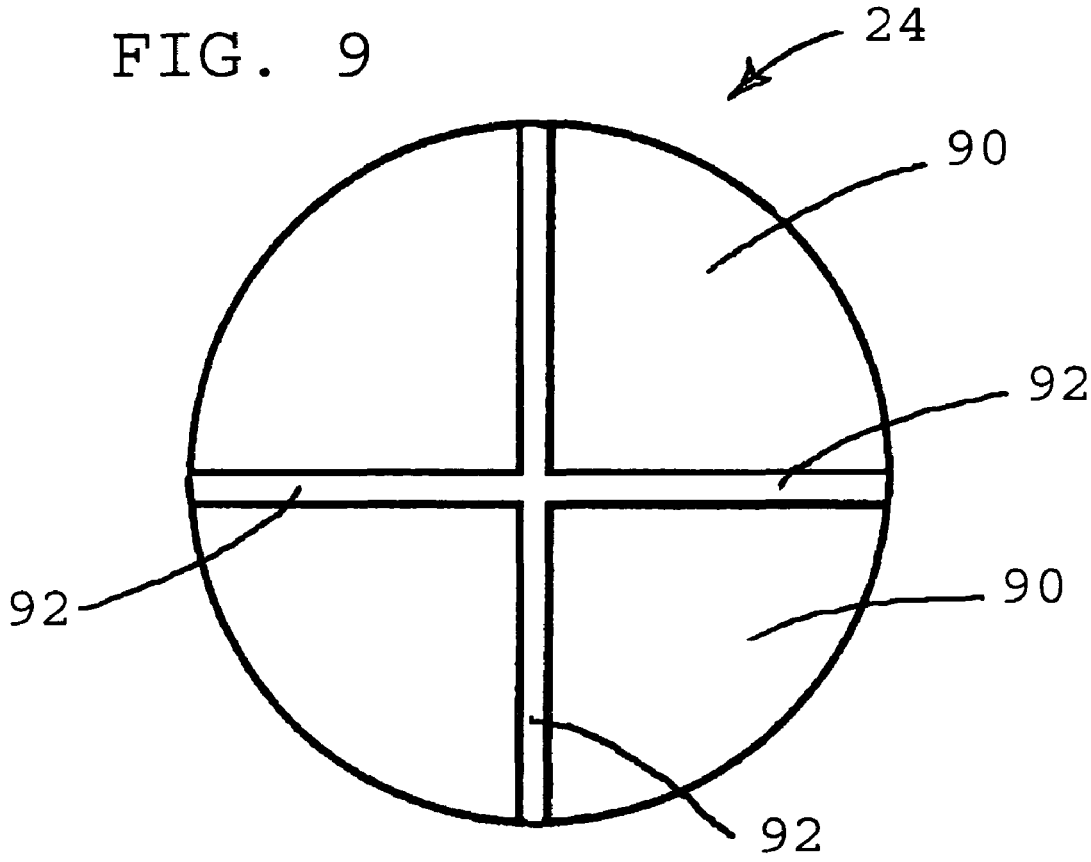
Figure 10:
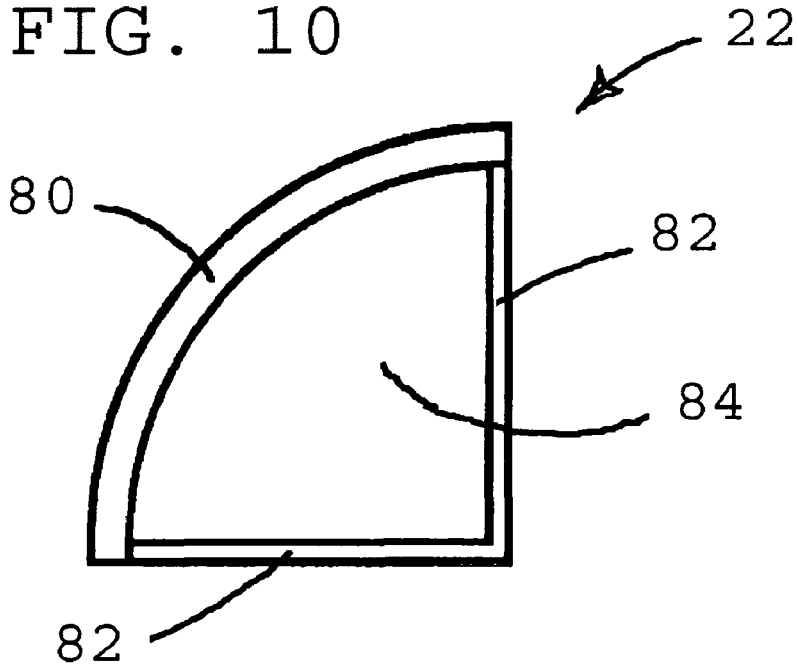

FIGS. 8-10, in which like elements share like reference numbers with FIGS. 1-3, show a perspective view, top view of the base, and bottom view of the room module, respectively, of another embodiment of a house toy and display. In this embodiment, the base fitting is a base projection 90 and the room module fitting is a floor recess 84, the base projection 90 being received in the floor recess 84.

Each of the room modules 22 fits over at least one of the base projections 90 in the base 24. Referring to the top view of the base 24 of FIG. 9, the base 24 includes base projections 90 separated by slots 92. As shown in the bottom view of the room module 22 of FIG. 10, the floor module rim 80 and the wall rims 82 define a floor recess 84 in the floor 26 of the room module 22. The floor recess 84 receives the base projection 90 and the slots 92 receive the wall rims 82 to support the room modules 22 on the base 24. Making the floor module rim 80 and the wall rims 82 extend equal heights around the floor recess 84 allows individual room modules 22 not in use in the house toy and display 20 to be stored away or displayed individually on a shelf.

One of the room modules 22 can fit over more than one of the base projections 90. For example, a semicircular room module would fit over two of the base projections 90 of FIG. 9. The number of base projections 90 can be set to allow more flexibility in arranging the room modules, i.e., a larger number of base projections 90 with smaller central angles allows more room modules with different floor shapes to be assembled on the house toy and display. Those skilled in the art will appreciate that many complementary shapes and geometries for the base fitting and the room module fitting, besides the base projection 90 and the floor recess 84 of this example, can be used to adapt the room modules to the base. Furthermore, the walls 28 need not follow the shape of the floor 26 as perpendicular planes, but can be curves, complex curves, or other shapes as desired.

It is important to note that FIGS. 1-10 illustrate specific applications and embodiments of the present invention, and are not intended the limit the scope of the present disclosure or claims to that which is presented therein. For example, different shapes, materials, and profiles can be used to produce a house toy and display that is aesthetically pleasing. The various parts of the house toy and display can be connected with mechanical fasteners, integrally molded, or made with interlocking fittings to ease assembly. Upon reading the specification and reviewing the drawings hereof, it will become immediately obvious to those skilled in the art that myriad other embodiments of the present invention are possible, and that such embodiments are contemplated and fall within the scope of the presently claimed invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A house toy and display, comprising:

a plurality of room modules, each of the plurality of room modules having a floor and at least one wall, the floor having an outer perimeter away from the wall, the wall having a height;

means for supporting the plurality of room modules; and means for fitting the plurality of room modules with the supporting means;

wherein a top plane of each of the plurality of room modules is open, the top plane being parallel to the floor and being at the height of the wall above the floor;

an outer surface of each of the plurality of room modules is open, the outer surface having a radial cross section like the outer perimeter, being perpendicular to the floor, and extending from the floor to the top plane; and the plurality of room modules being independently detachable from the supporting means.

2. The house toy and display of claim 1, wherein the fitting means further comprises means for retaining the plurality of room modules on the supporting means.

* * * * *